US007165655B2

(12) United States Patent
Cook et al.

(10) Patent No.: US 7,165,655 B2
(45) Date of Patent: Jan. 23, 2007

(54) NEURAL NETWORK DETECTION OF OBSTRUCTIONS WITHIN AND MOTION TOWARD ELEVATOR DOORS

(75) Inventors: Brett E. Cook, Tucson, AZ (US); Richard D. Pustelniak, Tucson, AZ (US); Gene L. Stagner, Tucson, AZ (US)

(73) Assignee: Otis Elevator Company, Farmington, CT (US)

( * ) Notice: Subject to any disclaimer, the term of this patent is extended or adjusted under 35 U.S.C. 154(b) by 278 days.

(21) Appl. No.: 10/514,930

(22) PCT Filed: May 14, 2002

(86) PCT No.: PCT/US02/15658

§ 371 (c)(1), (2), (4) Date: Nov. 12, 2004

(87) PCT Pub. No.: WO03/097506

PCT Pub. Date: Nov. 27, 2003

(65) Prior Publication Data

US 2005/0173200 A1 Aug. 11, 2005

(51) Int. Cl.
*B66B 13/14* (2006.01)

(52) U.S. Cl. ..... 187/316; 187/247

(58) Field of Classification Search ..... 187/313, 187/314, 316, 317, 391–393, 247; 318/280–286, 318/466–470, 568.1, 568.13, 640, 480; 49/25–28; 382/103, 156, 159

See application file for complete search history.

(56) References Cited

U.S. PATENT DOCUMENTS 5,001,557 A * 3/1991 Begle ..... 348/166
5,182,776 A 1/1993 Suzuki et al.
5,284,225 A 2/1994 Platt
5,298,697 A 3/1994 Suzuki et al.
5,387,768 A 2/1995 Izard et al.
5,410,149 A 4/1995 Winston, Jr. et al.
5,518,086 A 5/1996 Tyni
5,717,832 A 2/1998 Steimle et al.
6,050,369 A * 4/2000 Leone et al. ..... 187/392
6,339,375 B1 1/2002 Hirata et al.
6,386,325 B1 5/2002 Fujita
6,386,326 B1 5/2002 Pustelniak et al.
6,547,042 B1 4/2003 Collins
2001/0045327 A1 11/2001 Shemanske et al.
2003/0168288 A1* 9/2003 Deplazes et al. ..... 187/317
2006/0037818 A1* 2/2006 Deplazes et al. ..... 187/392

* cited by examiner

*Primary Examiner*—Jonathan Salata

(57) ABSTRACT

A camera (26), with suitable illumination (such as IR) provides images to a processing card (33) which converts the images to numerical vectors and applies them to a neural network (35) which is capable of providing a door-open signal (38) in response to something, either moving or still, in the paths of the doors (29), or anything moving in a manner to indicate intent to enter the elevator in the landing adjacent to the elevator (27). The door open signal is provided to the elevator door controller (39) to cause the doors to become or remain open in response to anything moving toward the elevator or anything disposed in the door pathway.

2 Claims, 3 Drawing Sheets

NEURAL NETWORK DETECTION OF OBSTRUCTIONS WITHIN AND MOTION TOWARD ELEVATOR DOORS

TECHNICAL FIELD

This invention relates to the detection of objects, whether moving or not, within the path of either elevator car or hoistway doors, and motion of passengers or objects toward the elevator by means of a pattern recognition neural network which provides a door open command in appropriate cases.

BACKGROUND ART

Typical systems utilized to detect objects in or near the path of an elevator door employ an array of light sources disposed vertically on one edge of a door which provide light beams that energize a corresponding array of photodetectors disposed on an opposite edge of the door, whereby interruption of a light beam will cause a door open command to cause a door to become or remain open. Such systems are generally satisfactory but have the characteristic of not sensing things which are not within the discreet paths of light. Furthermore, with the light arrays being in a single plane, there is the opportunity to not sense the presence of persons or things until they have been extended some distance into the door opening.

More complicated elevator door obstruction detection is disclosed in U.S. Pat. Nos. 5,387,768 and 5,410,149. However, apparatus according to these disclosures sense only motion, and therefore do not sense objects which are static or immobile within the door pathway. Furthermore, the processing of images is highly complex and requires significant software and software processing time. The adaptation of such complex devices to elevator landings which have different image responses is also very complex, slow and expensive, due to the nature of the processing involved.

Current light beam door obstruction detectors require flexing cables to provide power to and receive responses from the moving doors.

DISCLOSURE OF INVENTION

Objects of the invention include provision of an elevator doorway obstruction sensing system: which can sense not only objects or persons moving toward the elevator, while ignoring other motion, but also non-moving objects or persons in the pathway of the doors; which can be readily adapted to a wide variety of floor landing images, utilizing readily available software in a personal computer which need only be temporarily connected to the apparatus during the learning process, and thereafter removed; which is extremely fast and does not require complex image processing which can be readily adapted as a retrofit to a wide variety of elevator systems and floor landings; which does not require apparatus mounted on the doors; and which is easily implemented at relatively low cost.

According to the present invention, video images of a volume which includes a portion of the elevator door paths, including the door sills, and a portion of a landing adjacent to the elevator, including the landing floor adjacent to the sills, are converted into single-dimension numerical vectors, and passed through a pattern-recognizing neural network to provide an open door signal in response to one or more patterns recognized by the neural network as indicating something moving toward the elevator or as something within one or more of the door paths.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
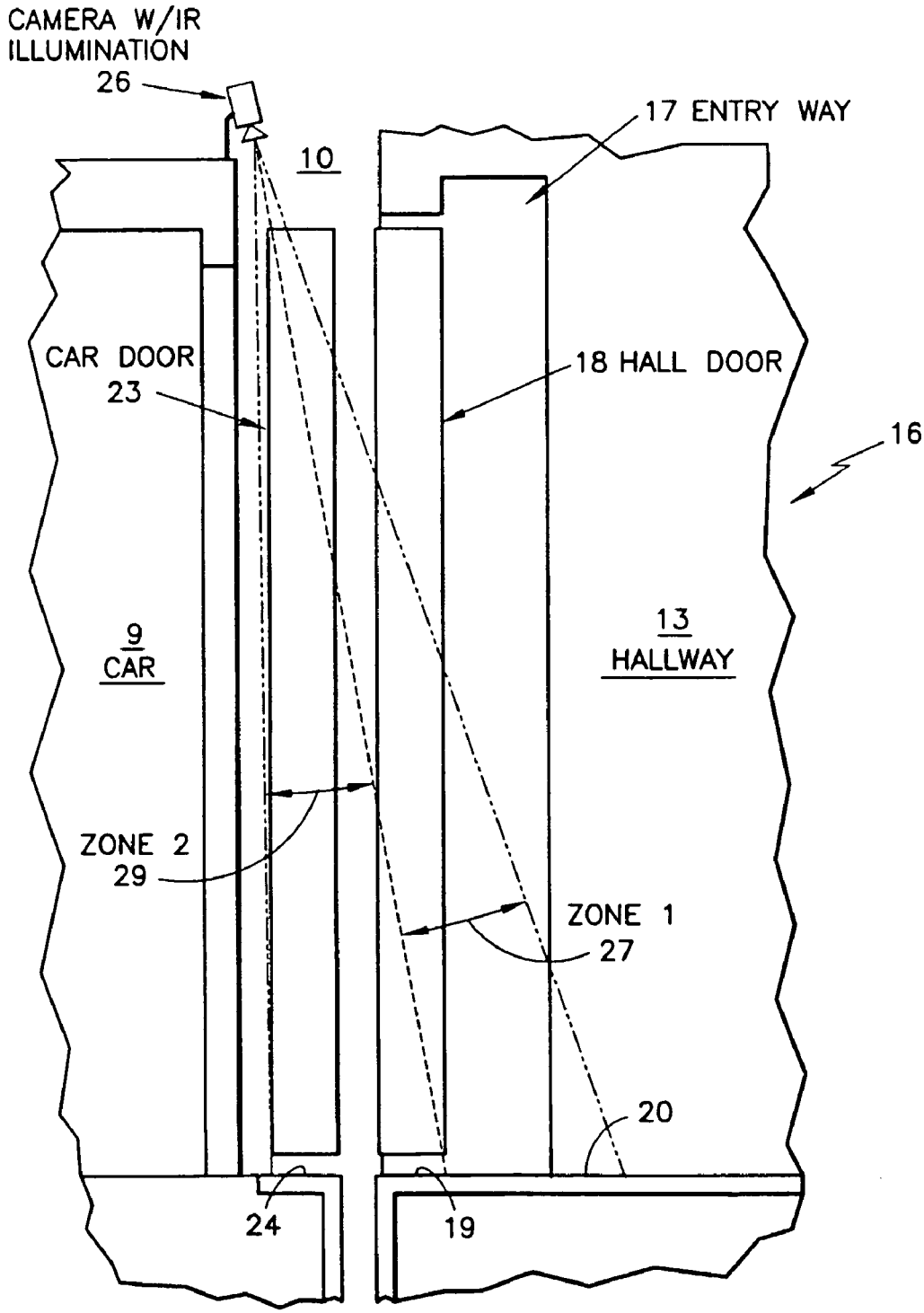
FIG. 1 is partial, stylized, schematic side elevation view of a portion of an elevator at a landing illustrating the present invention.
Figure 2:
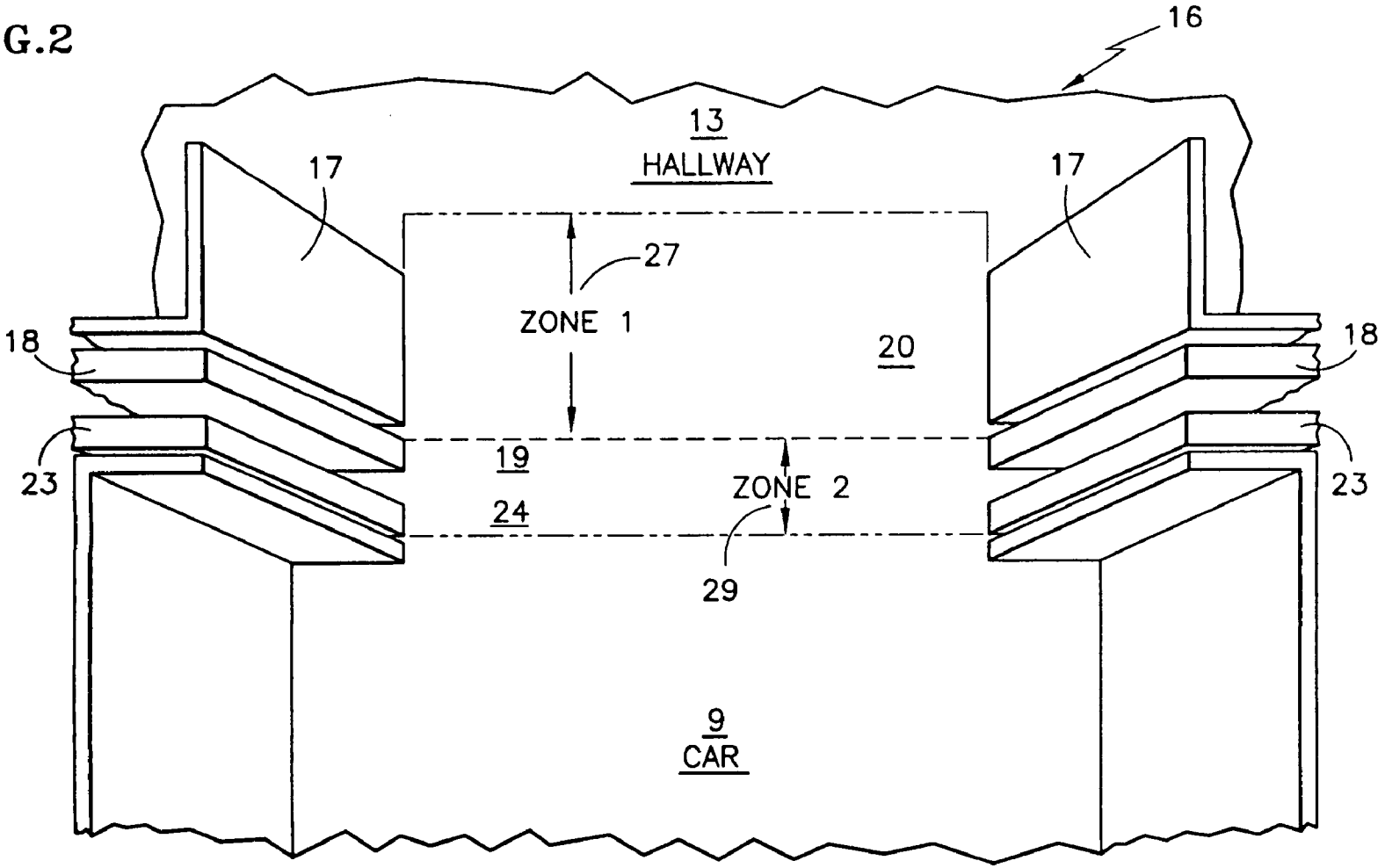
FIG. 2 is a simplified, stylized, top perspective view of the portion of the elevator at the landing.
Figure 3:
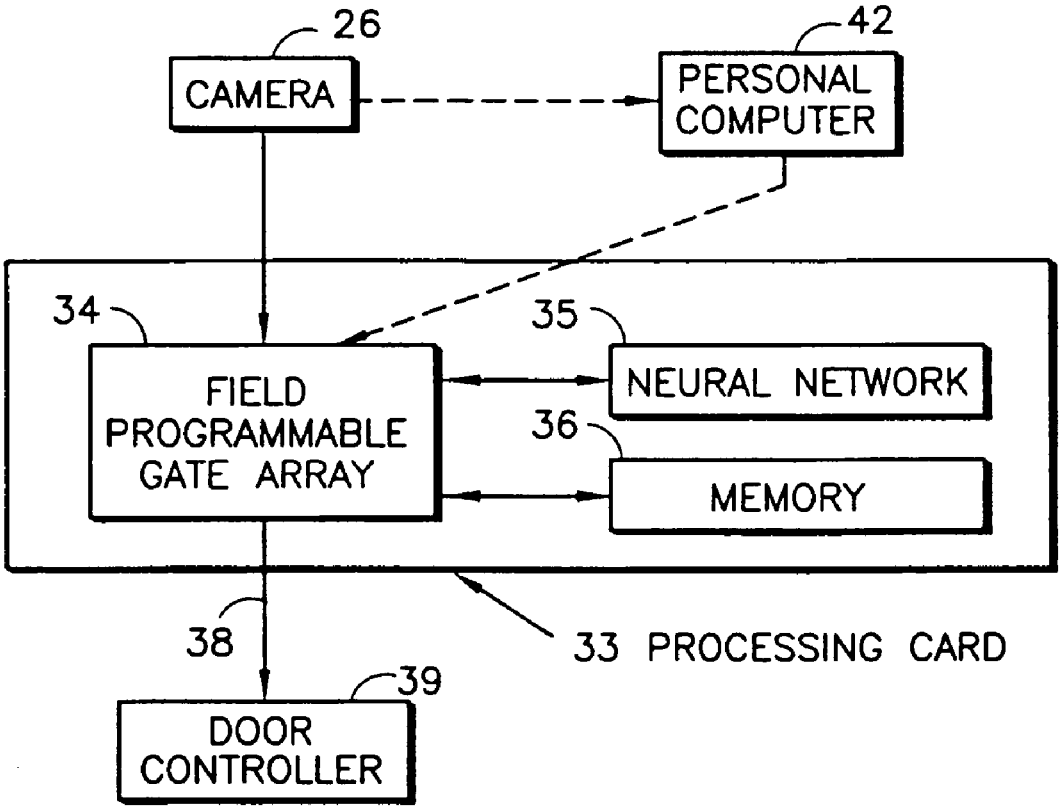
FIG. 3 is a simplified block diagram of apparatus according to the present invention.

Referring to FIGS. 1 and 2, an elevator 9 is positioned in a hoistway 10 adjacent a landing 12 in the hallway 13 of a building 16. The landing has an entryway 17, a hall or hoistway door 18, the door having a sill 19 and the landing having a floor 20. The car has a door 23 with a sill 24. On top of the car is mounted a camera 26 with suitable illumination, such as infrared radiation. The illumination includes at least a first zone 27 which includes a volume extending down from the camera to the sills 19, 24 and a portion of the landing floor 20 which is adjacent to the sill 19, and a second zone 29 which includes a volume extending from the camera down to both sills 19, 24, as shown in FIG. 1. As used herein, "doors" means single hoistway door, single car door, or multiple hoistway and car doors.

According to the invention, the camera is provided with a suitable objective lens to limit its view to zones one and two. Suitable illumination, to ensure that the zones of interest are properly illuminated, may comprise infrared illumination, which will not disturb passengers but will provide a reliable image intensity.

According to the invention, a first concept is to determine patterns within zone 2 for open doors (that is, viewing the sills), closed doors (that is, viewing the tops of the doors), and for doors that are opening and doors that are closing. Anything that does not match those images will trigger the generation of a door open command to cause the doors to become or remain open. Within zone 1, patterns are recognized that indicate movement indicative of a desire to enter the elevator. This may include indication of movement toward the elevator and may include movement of a person sideways in order to get around another person, and other movements which are learned to be indicative of an intent to pass through the doorway onto the elevator car. In this embodiment, zones 1 and 2 do not overlap. However, zone 1 may be extended to include zone 2, if desired, in any given implementation of the invention.

In FIG. 2, the camera 26 feeds a processing card 33 which includes, inter alia, a field programmable gate array 34, one or more neural network chips 35, and a memory 36. The neural network is sometimes referred to as Zero Instruction Set Computing (ZISC), since no program steps are involved in the processing. Video images provided to the processing card 33 are converted to a single numeric vector for application to the neural network. The processing card may comprise a neural network card marketed under the trade name NeuroSight, available from General-Vision, which can be located at http://www.general-vision.com along with additional description of the attendant technology. A description of an IBM neural network chip and networks incorporated therein, suitable for this invention, is found in U.S. Pat. No. 5,717,832. Instead of using an available NeuroSight card, a processing card can be customized to contain only the features required for the door obstruction sensing application of the invention. The output of the card 33 comprises, in one form or another, a door open signal on a line 38 which is provided to the door controller 39 of the elevator so as to indicate that the door is to become or remain open.

To teach the neural network 35 the intended recognition scheme, a personal computer 42 is connected to receive images from the camera and to provide control over the card 33. The P.C. 42 will have suitable software, such as Zisc Engine for Image Recognition software (ZEIFR), that allows the operator to teach the neural network patterns and to locate differences between an image and some template. Patterns can be based on pixel intensity, color and so forth, and pattern recognition may be base on either Radial Basis Function (RBF) or K-Nearest-Neighbor (KNN) models. Training the image recognition engine is achieved by marking objects on the screen of the P.C. and listing one of up to 200 categories that the image is to be associated with, or listing the desired outcome from sensing a particular image, and then clicking on the Learn button. Any area of the live video not recognized by the image recognition engine is marked with a colored rectangle. Such rectangles may be selected on the screen, matched with the desired category or outcome, and entered into the system. The learning which occurs in the image recognition software is downloaded to the processing card 33. Learning can be formed on either still or moving images. The recognition engine is able to ignore the motion of the doors, patterns or colors in the environment, (floors, walls, etc.) or images and reflections from the clothing worn by people within the field of view.

The invention claimed is:

1. Apparatus for detecting obstructions within paths of elevator doors having sills (19, 24) and motion of passengers or objects toward the elevator (9), comprising:

means (26) for illuminating a volume (29) which includes (a) a portion of said paths, including the door sills, and (b) a portion of a landing (13) adjacent said elevator, including a landing floor (20) adjacent to said sills;

means (26) for continuously providing successive video images of said volume;

means (34) for converting each of said video images into a single-dimension numerical vector;

a pattern recognizing neural network (35) capable of providing a door-open signal in response to one or more patterns recognized by said neural network as indicating something moving toward said elevator or as something within one or more of said paths;

means for applying each said vector to said neural network;

an elevator door controller (39) for controlling the opening and closing of said doors; and means (34, 38) for applying said door open signal to said elevator door controller for controlling the opening and closing of said doors to cause said doors to become or remain open.

2. A method of detecting obstructions within paths of elevator doors having sills (19, 24) and motion of passengers or objects toward the elevator (9), said method comprising:

(a) illuminating (26) a volume (29) which includes (a) a portion of said paths, including the door sills, and (b) a portion of a landing (13) adjacent said elevator, including the landing floor (20) adjacent to said sills;

(b) continuously providing (26) successive video images of said volume;

(c) converting (34) each of said video images into a single-dimension numerical vector;

(d) applying each said vector to a pattern-recognizing neural network (35) capable of providing a door-open signal in response to one or more patterns recognized by said neural network as indicating something moving toward said elevator or as something within one or more of said paths; and (e) applying (38) said door open signal to an elevator door controller (39) for controlling the opening and closing of said doors to cause said doors to become or remain open.

* * * * *